United States Patent [19]

Rich

[11] 4,036,827

[45] July 19, 1977

[54] CONDUCTIVE LIQUID SWITCHES

[75] Inventor: Donald S. Rich, Flanders, N.J.

[73] Assignee: Inflo Systems, Inc., Chester, N.J.

[21] Appl. No.: 586,543

[22] Filed: June 13, 1975

Related U.S. Application Data

[63] Continuation of Ser. No. 345,358, March 27, 1973, which is a continuation-in-part of Ser. No. 197,707, Nov. 11, 1971, and Ser. No. 300,484, Oct. 25, 1972, abandoned.

[51] Int. Cl.[2] ..... H01H 29/02

[52] U.S. Cl. ..... 200/209

[58] Field of Search ..... 200/209, 187, 182, 83 J; 335/52

[56] References Cited

U.S. PATENT DOCUMENTS

| | | | |
|---|---|---|---|
| 1,646,764 | 10/1927 | Queeney | 200/209 |
| 1,806,236 | 5/1931 | Charles | 200/209 |
| 3,519,965 | 7/1970 | Horowitz | 200/209 |

*Primary Examiner*—Herman J. Hohauser
*Attorney, Agent, or Firm*—Philip Furgang

[57] ABSTRACT

Disclosed is a switch. The switch housing has a cavity therein. In one embodiment a plunger has selected portions cut away so as to form, in combination with the side walls of the cavity, two contiguous chambers. Thus, the first chamber communicates with the second chamber. Mercury is placed in the larger chamber and remains there, irrespective of the position of the switch housing. Upon depression of the plunger, the mercury is forced into the smaller chamber. Upon removal of the plunger, the displaced mercury returns to the larger chamber. Electrical contacts are disposed in the two chambers. The mercury, displaced by the plunger, will couple the contacts and close the switch. It, upon operation of the switch at high frequencies, mercury is pumped out of the chambers and passes above the plunger and within the cavity, a channel of smaller dimension than either chamber, which extends the length of the plunger, acts to direct such mercury back to the first chamber. A small amount of mercury is disposed between the top of the plunger and the cavity to prime the return of mercury.

30 Claims, 11 Drawing Figures

FIG. 5
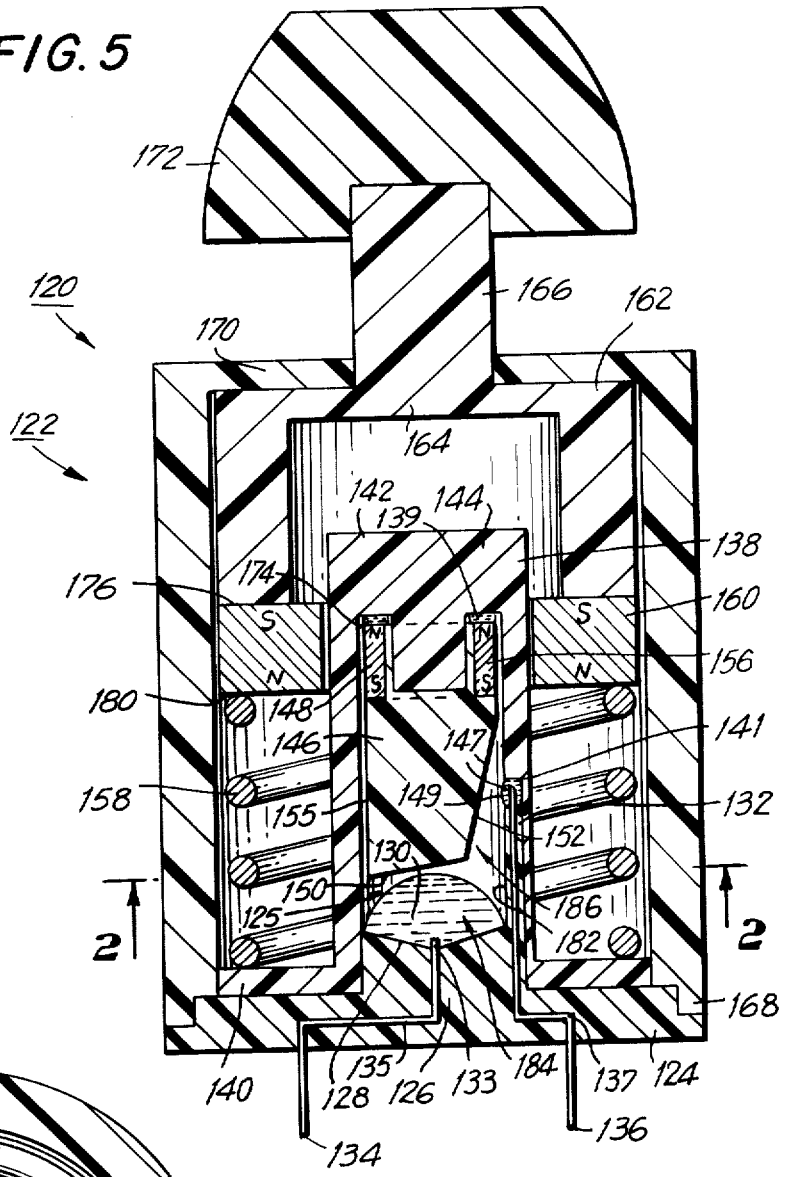
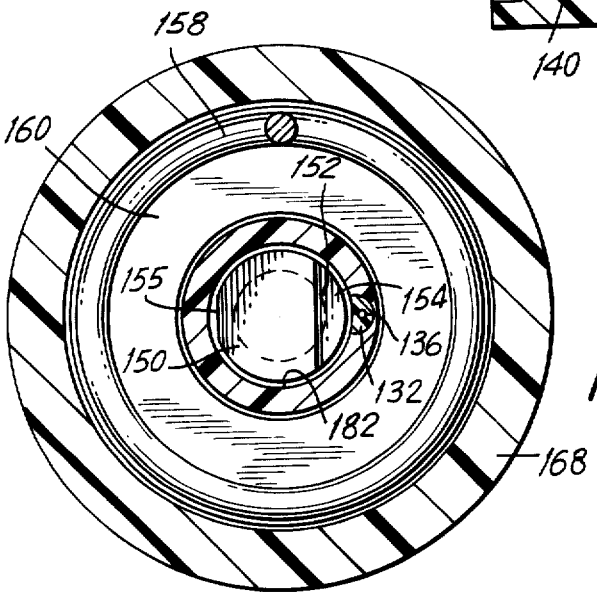
FIG. 7

FIG. 6
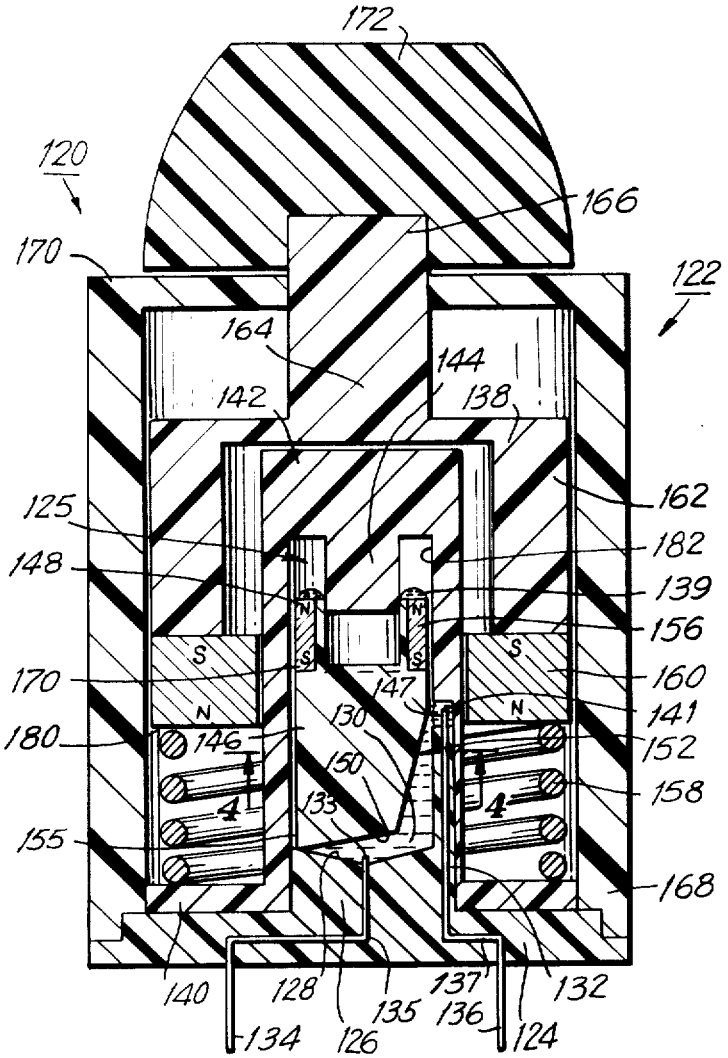
FIG. 8
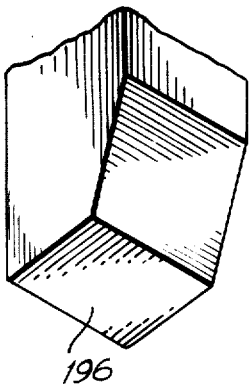
FIG. 10
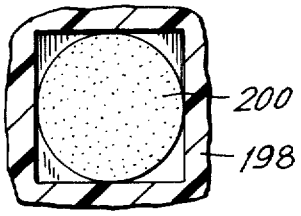
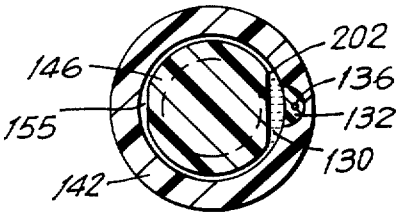
FIG. 11
FIG. 9
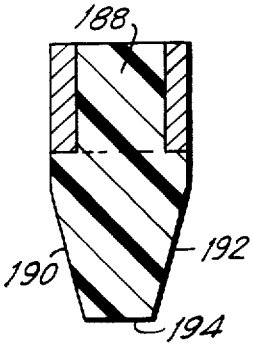

CONDUCTIVE LIQUID SWITCHES

CROSS-REFERENCE TO A RELATED APPLICATION

This is a continuation of application Ser. No. 345,358, filed Mar. 27, 1973, which is a continuation-in-part of application, Ser. No. 197,707, filed Nov. 11, 1971, and application, Ser. No. 300,484, filed Oct. 25, 1972, now abandoned.

BACKGROUND OF THE INVENTION

This invention relates to means for switching and more particularly to switches which employ an electrically conductive liquid therein.

Various attempts have been made to provide switches which are fast operating, accurate, and very sensitive. Generally, these efforts have been directed to the area of minaturization of mechanical switches. Attempts have been made to adapt such switch mechanisms to the keyboards of such devices as cash registers, desk calculators, or the like or to use them as sensing devices. All too often such switches suffer from one or a number of deficiencies and their use often requires a compromise in operating characteristics. Fast, miniaturized switches are belived to be often failure-prone and of a complex design. Larger, simpler switch constructions are, on the other hand, often slow in response time.

In miniaturization of switches it is a desirable goal to eliminate as many mechanically interrelated parts, to simplify manufacturing costs, and, at the same time, maintain a high degree of reliability. One frequently tried approach is to employ a conductive fluid, such as mercury, as the contact or "throw" of the switch. One basis for employing mercury is that it will not suffer the wear and failure of throws made of solids. Such solid throws are mechanically linked to switch contacts and are the first parts of such switches to experience wear. Thus, an electrically conductive fluid used in place of a mechanical throw clearly improves the life of a switch. However, such switches are not believed to be capable of fast operation. Most importantly, such switches are dependent upon their position with respect to ground since the mercury throw position or resting place is dependent on gravity.

Still another problem in the use of a switch is encountered when it is employed as a sensing device. Where switch contact elements (such as push buttons or lever arms) are used to directly sense the holes punched in, for example, a hollerith card or the embossments on a credit card, difficulty is encountered. The requirements of spacing make it hard to fit such switches into a confined space. Dust and dirt very often play a material part in the life of such switches.

With particular reference to the credit card industry, the importance of small, accurate, and long-lasting switches becomes immediately apparent. One suggested means for reading the embossments on credit cards, for example, comprises a series of seven fingers appropriately placed and secured to L-shaped pivot members. As each finger is depressed, the one arm of the L-shaped member to which it is attached pivots outwardly. A magnetized tooth is affixed to the other arm of the L. This pivotal placement requires a second step. A magnetic head proceeds past the teeth and "reads" their position thus determining the symbols "read" by the fingers. This system therefore requires mechanical interlinkage and the capability of magnetically reading the teeth. Thus, there is provided a mechanically cumbersome and intricate device for reading embossed or punched indicia. Embossments must be read mechanically. The mechanical reading must then be read magnetically and finally translated into electrical signals.

Still another device employs optical reading of punched or embossed indicia. This is believed to be a relatively expensive arrangement. The expense may well be prohibitive where, for example, it is desirable to put a credit card reader into the hands of small merchants or large stores with numerous reading stations.

Optical sensors must first provide mechanical means for interrupting light transmitting means and then convert the light patterns produced thereby into electrical signals. Because of the expense of individual sensors, it is usually required that each character be read one at a time, a time-consuming activity. In addition, dust may block holes thereby giving a false reading.

The sensitivity of a switch employed to read, for example, embossed letters and numbers on credit cards may be appreciated by the dimensions suggested by the American National Standards Specifications for Credit Cards, ANSI X4,13-1971 that suggest that embossed letters and numbers have a height above the card of 0.019 +0.000 and −0.002 of an inch and be OCR Size C or Farrington 7B type style. Thus, if a seven point measuring array is used, such seven switches must each occupy an area of approximately 1.35 of an inch by 0.196 of an inch.

Reading such characters directly by a switch offers the difficulty of fitting such switches into a very small space.

A number of switches have been devised employing mercury as a throw. Few, however, are so designed as to be employed for miniaturized use for reading credit card numbers, rapid reading, or for continuous use in an environment of dust or dirt.

One example of a suggested mercury switch is provided by Charles in U.S. Pat. No. 1,806,236. That patent disclosed a plunger floating on a pool of mercury in a cavity formed in a housing. The plunger is provided with a plurality of channels which, in conjunction with the side wall of the housing forms passageways. When the plunger is depressed, mercury is guided up the passageways and into contact with electrical contacts in the wall of the housing. However, Charles employed this switch so that mercury would flow freely. The main object of the switch was to permit the mercury to flow out of the cavity and into contact with shorting contacts. The result of such an arrangement was that if the switch were installed in an automobile and that automobile turned over, the switch would spill its mercury thereby shorting the switch and turning off the devices to which it was coupled, such as a motor.

Another suggested device is provided by Lanctot in U.S. Pat. No. 3,184,693. Lanctot proposes a circular recessed body member for holding a quantity of mercury. Disposed over the entire area is a flexible diaphragm. Pressure upon the diaphragm is used to distort the mercury to couple electrical contacts at the periphery of the body member. This device suffers from a number of disadvantages. For example, the device may be position sensitive. A sudden jolt to the switch can dislodge the mercury to one side, destroying the switch operation. Further, depression of the diaphragm must necessarily require any gas (such as air) in the area to be displaced. Atmospheric conditions may cause the diaphragm to become distorted, further distorting the operational characteristics of the swtich. Lanctot, however, discloses no means for removal of the gases displaced by the mercury and diaphragm. If, on the other hand, the mercury were placed in a vacuum, the diaphragm would necessarily be pulled inward making the device inoperative. Still another problem with such a device is that mercury abhors corners. That is, the mercury will tend to withdraw from the edges and thereby resist being pushed toward the electrical contacts. Thus, the "making" of such a switch may be extremely unreliable. Further, the use of a flexible diaphragm provides a moving part which may be subject to permanent deformation or wear.

Still another device has been suggested by Schmid in U.S. Pat. No. 3,358,109. Schmid proposes a plate with pools of mercury disposed in recesses formed therein. The plate is made of an insulating material and the recesses comprise the ends of electrical contacts. An actuating plate of insulating material is employed to press down upon the mercury pools, causing them to flow and join thereby making the switch. Schmid, however, uses the two pools of mercury as extensions of the contacts. The amounts of mercury at each location is clearly variable, and a function of the amount each pool pulls to itself when the actuating plate is raised. Thus, the operating characteristics of the switch may vary considerably. Furthermore, the flowing mercury, and closing of the space between the plate and actuating plate, requires that the gases trapped within the space must be displaced. Schmid specifies that the switch he proposes be hermetically sealed and shows no means of removing the displaced gases. Thus, gases may be forced into the pools, distorting their operation and blocking electrical contact between pools.

SUMMARY

It is, therefore, an object of this invention to provide a switch which may be easily miniaturized, is simple to construct, and economical to manufacture.

It is still another object of this invention to provide a switch which provides accurate operation.

It is a further object to provide a switch construction which lends itself to a module, plug-in design.

It is a further object of this invention to provide a switch which is capable of responding to small pressures.

It is a further object of this invention to provide a switch and a method of making same which is both economical and capable of having a long operating life.

It is still another object of this invention to provide a method for reading indicia.

It is still another object of this invention to provide a switch which employs an electrically conductive liquid and is substantially insensitive to displacement with respect to the force of gravity.

It is still a further object of this invention to provide a substantially bounce-free switch.

It is an additional object of this invention to provide a switch which exhibits hysteresis characteristics.

To accomplish these objectives there is provided a switch comprising a housing. The housing has a cavity therewithin. Within the cavity is a plunger which defines, in conjunction with the walls of the cavity, at least one chamber. A quantity of an electrically conductive liquid is in the chamber in an interior portion thereof. The surface tension of the liquid prevents the liquid from entering a peripheral portion of the chamber irrespective of the orientation of the switch. The switch has electrical contacts within the cavity and extending out of the housing. The plunger has at least two operating positions. In one position, the plunger displaces a portion of the liquid into the peripheral portion. In one of the plunger positions, the liquid electrically couples the contacts in the other plunger positions, the liquid does not couple the contacts.

In another aspect of this invention, there is provided a switch having a housing. Within the housing is a cavity defined by a bottom and at least one side wall. An electrically conductive liquid is placed within the cavity. Plunger means are within the cavity in contact with the liquid. A passageway is defined by the surfaces of the plunger means and the side wall of the cavity. The passageway extends substantially upward with respect to said first surface of the housing. Electrical contact means are provided. At least one electrical contact means is in the passageway. Upon depressing the plunger means, the fluid moves into the passageway thereby electrically coupling at least two of the contact means. The cavity and the plunger are so dimensioned that upon depressing the plunger, the liquid displaced will be substantially confined to the passageway.

In one embodiment of the invention, there is provided a cavity having therein a quantity of mercury so dimensioned that the surface skin is substantially in contact with the base of the switch cavity. The chambers are defined by the base and bottom wall of the plunger and by a narrow chamfer in the side of the plunger and the side wall of the cavity. The upper most end of the chamber forms an acute angle with the side wall of the cavity.

In another embodiment of the invention, the plunger is held within the cavity by a resilient diaphragm which, in turn, serves to support push button means.

In still another embodiment of the invention, the plunger is surrounded by a boot-like resilient means which serves to resiliently withdraw the plunger from the fluid after it has been depressed.

In a further embodiment, the plunger includes magnetic means and a magnetic means is within the contact finger. The plunger and the contact means are separated by substantially rigid sealing means. Upon pushing the finger means toward the plunger, the plunger in magnetic response thereto, moves downwardly into the fluid.

BRIEF DESCRIPTION OF THE DRAWING

FIG. 5 is a sectional plan view of a switch constructed in accordance with the teachings of this invention;

FIG. 6 is a sectional plan view of the switch of FIG. 5 in another operating position;

FIG. 7 is a sectional view of the switch of FIG. 5 taken along lines 7—7;

FIG. 8 is a partial, perspective view of a plunger constructed in accordance with the teachings of the invention;

FIG. 9 is a partial, sectional view of the base of a housing constructed in accordance with the teachings of the invention;

FIG. 10 is a sectional view of another plunger constructed in accordance with the teachings of this invention; and FIG. 11 is a sectional view of the inner housing of the switch of FIG. 6 taken along lines 11—11.

DESCRIPTION OF THE PREFERRED EMBODIMENTS

Figure 1:
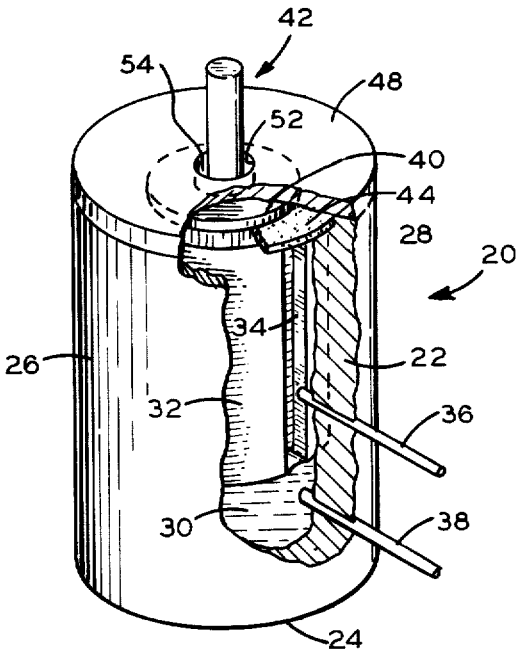
FIG. 1 is a perspective, partially sectioned view of the switch constructed in accordance with the teachings of this invention.

It has been observed that liquids, such as, for example, mercury, tend to pull into a sphere. It is well known that the only limitations upon reaching this shape are: the wettability of the surface or surfaces in contact with the liquid, the effect of the force of gravity upon the entire quantity of liquid, the nature of the fluid with which the liquid is in contact (e.g., water, air, etc.), and the ambient temperature.

Thus, given a small amount of, for example, mercury on a nonwettable surface, the mercury will, as has been indicated, tend to draw into at least an arcuately contoured skin surface which tends to approach the shape of a sphere. On the other hand, if mercury is confined between intersecting, non-wettable planes, it will tend to move outwardly or away from the apex of the planes. This occurs because of the strong restorative forces set up by the surface tension which keeps urging the mercury to assume the shape of a sphere. This characteristic has been described in Elementary Treatise on Physics by Ganot (William Wood & Co., 1890), pages 116–117, and is referred to herein as the "Ganot effect."

Turning now to the drawing, there may be seen the application of these characteristics. There is disclosed in FIGS. 5 and 6 a switch 120. The term "switch"0 as used herein is understood to apply to all types of switch mechanisms including relay and manual switches. The switch 120 has a housing 122. The housing 122 may be generally cylindrical and comprise several parts. Thus, the housing 122 has a disk-shaped base member 124 with a centrally disposed pedestal 126. The pedestal 126 may have a generally recessed, cone-shaped upper surface 128 upon which may be placed a quantity of an electrically conductive liquid, such as mercury 130. The quantity of mercury 130 is so provided such that the surface skin forms an arcuate contour. Thus, the mercury, in cross-section, is substantially defined by the upper and the support surfaces.

Extending perpendicularly with respect to the base 124 and adjoining the pedestal 126, is an arm 132. At the apex 133 of the cone-shaped upper surface 128, and extending through the base 124 and without, may be an electrical contact 134. Similarly, extending through and without the arm 132 and base 124 may be a second electrical contact 136.

An inner housing 138 may be, for example, generally cylindrical and hollow with an outwardly extending flange 140 at the base thereof. The inner wall surface 182 of the inner housing 138 compliments the outer diameter of the pedestal 126 to form a snug fit. One portion of the interior wall 182 may have a groove (not visible in FIGS. 5 and 6) so as to admit the arm 132 of the base 124. The arm 132 in combination with the interior wall surface 182 forms a continuous cylindrical surface and an enclosed cavity 125. While the manner of moving a plunger 146 may be deemed of interest, of greater importance is the disclosure herein of the housing 122 and its plunger 146 and interrelated parts therein.

A top wall 142 of the inner housing 138 closes the hollow cylinder at one end. Extending downwardly from the top wall 142 and within the inner housing 138 is a tongue 144.

A plunger 146 is placed within the inner housing 138 and has a generally cylindrical shape so as to conform to and move easily there within. The upper end 148 of the plunger 146 has a groove (not visible in FIGS. 5 and 6) which engages the tonuge 144 of the inner housing 138.The tongue 144 and groove are of sufficient length and depth so that they remain engaged throughout the movement of the plunger 146, thereby assuring the plunger 146 of a fixed orientation within and with respect to the inner housing 138.

A base wall 150 of the plunger 146 may take any convenient shape. Thus, for example, the wall 150 may be at an acute angle with respect to a radial plane (not indicated) intersecting the axis (not indicated) of the plunger 146.

One corner of the plunger 146 may have a chamfer or groove 152 extending upwardly and at an acute angle with respect to the axis. The groove 152 terminates at the generally circumferential surface of the plunger 146. A chamfer, flat, or channel 155 (see FIGS. 7 and 11) extends upwardly along one side of the plunger 146. The function of this channel 155 will be more fully discussed below.

A toroid of magnetically responsive material, such as, for example, steel or a permanent magnet 156, is secured to the plunger 146. The outer or exterior surface of the steel toroid 156 is cylindrical and is coincident with the cylindrical outer surface of the plunger 146.

Place about the inner housing 138 and supported upon the flange 140 thereof may be any form of resilient means, such as a helical spring 158. Resting upon the helical spring 158 and surrounding the inner housing 138 may be magnetic means, such as a toroidal permanent magnet 160. The magnet 160 may be positioned so that its movement, with respect to the plunger 146, will cause the plunger 146 to move inside the inner housing 138. This relationship will be more fully described hereinafter.

Resting upon the magnet 160, and having a generally hollow cylindrical cup shape, is a push button housing 162. The inner circumference of the push button housing 162 is so shaped as to move easily about the inner housing 138. Extending perpendicularly from the top wall 164 of the push button housing 162 may be a stem 166. The top wall 164 of the push button housing 162 acts as a stop to prevent the downward movement thereof when it abuts the top wall 142 of the inner housing 138.

An outer housing 168 may be cylindrical in shape, hollow, and have a top wall 170 closing one end. The stem 166 may extend outwardly through an aperture (not indicated) therein. The interior of the outer housing 168 may be so dimensioned as to permit axial movement of the push button housing 162 and magnet 160 therewithin. A push button 172 may be secured to the stem 166.

The housing 122 and plunger 146 may be made of any well-known material, preferably a non-wettable plastic such as Teflon, Selanex, or Delrin. It is desirable to seal the switch 120 against the effects of ambient atmosphere so as to keep the interior thereof free of dirt and the like. This is particularly true in securing such parts as the inner housing 138 to the base 124. Thus, the above-noted plastic materials may be sealed by means of heat. Other structural materials may be used to form the housing 122 and plunger 146 of the switch 120.

The electrical contacts 134 and 136 may be made of any suitable material such as, for example, nickel. It has been observed, however, that mercury chemically combines with nickel to follow the contacts 134 and 136 through the plastic base 124. To avoid this, a main body portion of a non-wettable material, such as oxidized steel, is provided with a coating of a wettable material, such as nickel, only on that portion of the contacts 134 and 136 exposed to the mercury 130. This may be done by masking the contacts 134 and 136 with a masking material, such as plastic, epoxy, or the like. After plating the unmasked portions of the contacts 134 and 136 with nickel, the contacts 134 and 136 may then be placed in the base 124 and sealed under heat.

In assembly, the contacts 134 and 136 may be disposed within the base 124 and sealed therewithin. To avoid having the contacts 134 and 136 pulled from the base 124, it is preferable to provide the contacts 134 and 136 with Z-shaped bends 135 and 137, respectively. In this way, any forces exerted upon the exposed ends of the contacts 134 and 136 will be transmitted to the base 124. In addition, the longer and more indirect the path formed by the contacts 134 and 136 from the cavity 125 to the exterior of the switch 120, and less likely that any gases within the cavity 125 will escape (assuming that a gas has been placed in the switch 120)

Mercury 130 is placed upon the pedestal 126. A smaller amount of mercury 139 is placed in the cavity 125 resting upon the top wall 142. The plunger 146 is placed in the inner housing 138 and the inner housing 138 is joined to the base 126.

It will be noted that the arm 132 is of somewhat shorter length than the slot in the inner housing 138. Thus, a small enclosure 141 is formed and defined by the arm 132 and the slot. The exposed end 147 of the contact 136 is within the enclosure 141. The inner housing 138 is joined to the base 126. The spring 158 is placed upon the flange 140 and the magnet 160 upon the spring 158.

In operation, the magnet 160 is positioned, with the spring 158 in a relaxed condition (FIG. 5), so that the top 174 of the steel toroid 156 is located between the center of the axis and the top 176 of the magnet 160. In the lowermost travel position of the magnet 160, the bottom 178 of the steel toroid 156 lies between the center of the axis and the bottom 180 of the magnet 160 (FIG. 6). The respective positions of the magnet 160 and steel toroid 156 represent the most efficient use of the magnetic field (Standard Handbook for Electrical Engineers, A. K. Knowlton, Editor, eighth Edition, McGraw-Hill, 1949, pg. 493). The plunger 146 moves in response to the magnetic field of the magnet 160 upon the steel toroid 156.

One disadvantage of switches that employ large amounts of mercury, is that the gases within the switch often become entrapped between the mercury and other essential operating parts, such as electrical contacts, thereby interfering with the switch operation. In order to provide free movement of the mercury within the switch, and to employ its natural restorative forces, it is desirable to have the mercury attempt to draw itself into a sphere. If a limited amount of mercury is employed, the upper surface will assume an arcuate contour which will extend substantially to the base upon which it rests. In this context, the mercury 130 of the switch 120 may, for example, just contact the side wall 182 of the inner housing 138 or, as shown, be substantially free from the side wall 182, thereby forming, in cross section, a semi-elipsoid upper surface.

The movement of the magnet 160 will, as has been previously stated, move the steel toroid 156 either toward or away from the base 124. Clearly, as will be seen from the other examples provided herein, magnetic means is but one method of moving the plunger 146. For example, the plunger 146 may be moved by direct forces placed thereon by securing it to a push button. The use of magnetic means, however, permits the hermetic sealing of the switch 120.

In order to move the plunger 146 with the magnet 160, it is desirable that the inner housing thickness be so dimensioned as to pass as much magnetic flux as possible. Thus, in one example, the plastic employed may be 0.01 inches thick.

The plunger 146 (and steel toroid 156) may have an outer diameter of 0.14 inches and a clearance of 0.001 to 0.0005 inches between the plunger 146 and the inner housing wall 182. In the example provided herein, the axial length of the plunger, to the lower most point of the bottom wall 150, may 0.6 inches. The bottom wall 150 of the plunger 146, as has been previously indicated may extend upwardly at an acute angle with respect to a radial plane. The purpose of this angle is three fold: First, as pointed out, mercury repells from the juncture of two planes (in this case, the plunger 146 and pedestal upper surface 128). This repelling force encourages the mercury 130 to move toward the groove 152 upon the depression of the plunger 146. Secondly, the edge of the plunger 146 adjoining the side wall 182 of the inner housing 138 acts as a wiper arm to clear or move the mercury 130 away and thereby inhibit the movement of the mercury 130 between the side wall 182 and the plunger 146. Third, the canting of the bottom wall 150 upwardly, with respect to the upper surface 128 of the pedestal 126, prevents physical contact between the plunger 146 and the base electrical contact 134. In the example provided herein, the base wall 150 of the plunger 146 may extend upwardly at an angle of approximately six degrees with respect to the aforementioned radial plane. It is not considered essential that the base 150 may be horizontal. In addition, it is not required tha the upper surface 128 of the pedestal 126 have a cone-shaped depression. This shape, it is believed, encourages or assists the mercury 130 to assume the arcuately contoured surface skin and permits the base contact 134 to be further removed from any physical contact with the plunger 146.

The chamfer 152 may assume any desired shape, extending substantially vertically (or parallel the axis of the plunger 146). Thus, in the present example, the vertical wall of the chamfer 152 may extend upwardly from the base wall 150 at an angle of approximately 5°, with respect to the axis of the plunger 146 to the circumferential outer surface of the plunger 146. The bottom wall 150 may end at a point .1 inches from the circumferential outer edge of the plunger 146.

The angular relationship of the chamfer wall 152 and the side wall 182 encourages the movement of mercury 130 out of the chamfer 152 upon the withdrawal of the plunger 146. Thus, the mercury 130 will naturally pull out of the chamfer 152 when the pressure by the plunger 146 upon the mercury 130 on the upper surface 128 is removed. A sufficient amount of mercury 130 is present so that at full travel of the plunger 146, mercury 130 is driven up into the chamfer 152. Because of the Ganot effect, what ever mercury 130 is lodged in the chamfer 152 will return to the upper surface 128 upon the withdrawal of the plunger 146 to its original position. Obviously, for good electrical contact between the two contacts 134 and 136 it is imperative that there be a continuous mercury path therebetween.

The enclosure 141 serves a most useful purpose in the operation of the switch 120. During its operation, a small amount of mercury 149 is about the wettable contact 147 in the enclosure 141. The small amount of mercury 149 effectively forms a protective covering about the contact 136 which is always wettable, will not oxidize and assures a clean make and bereak for each operation of the switch 120.

The small amount of mercury 139 in the cavity 125 on top of the plunger 146 serves a useful function in combination with the flat 155. If the switch 120 is subjected to high enough vibrational forces or is operated at high speeds (e.g., greater than thirty times a second), a scattering effect may, on occasion, be observed. Mercury 130 may, under these extreme conditions, be forced out of the base 124 and chamfer 152 and up the sides of the plunger 146. Ordinarily, this mercury 130 would find its way to the top of the plunger 146 to be lodged at the top of the switch cavity 125. With the small amount of mercury 139 at the top of the plunger 146, in combination with the flat 155, the scattered mercury 130 will be pumped back to the base 124 through the flat 155. It should be observed that the flat 155 is of a significantly smaller dimension than the chamfer 152 such that it ordinarily inhibits the flow of mercury 130 therein.

Taken from another viewpoint, it will be seen that the cavity 125 is divided by the plunger 146 into two chamfers 184 and 186. The first chamfer 184 is defined by the upper surface 128 of the pedestal 126, the side wall 182 of the inner housing 138, and the bottom wall 150 of the plunger 146. The second chamber 186 is defined by the side wall 182 of the inner housing 138 and the walls of the chamfer 152. The dimensions of the two chambers are selected such that the mercury 130 in the first chamber 184, because of the surface skin, will not enter the second chamber 186 despite the orientation of the switch 120 with respect to the ground. Only upon the lowering of the plunger 146 by the pushing toward the base 124 of the magnet 160 will mercury 130 be forced into the second chamber 186. Then and only then are the two contacts 134 and 136 coupled.

In the example provided herein, the mercury 130 can be caused to rise in the groove 152 to approximately four times the downward distance of the plunger 146. Clearly, the shorter the movement of the plunger 146 within the inner housing 138, the less wear and faster reaction time of the switch 120.

On the other hand, a typical keyboard is found to require movement of about three sixteenths of an inch. It will be observed, therefore, that the movement of the magnet 160 far exceeds the movement of the plunger 146. Thus, in the example provided herein, the magnet 160 will move the three sixteenths of an inch (as will the push button 172) while the plunger 146 will move 3 thirtyseconds of an inch. These relative distances are derived from the aforesaid positions of the steel toroid 156 and magnet 160 at the ends of their respective travels. It has been found that the switch 120 will operate successfully with a minimum force of 10 to 15 gms. on the push button 172. The operating pressure, response time, and travel of the plunger 146 may be varied by altering the geometry of the switch 120.

As may be observed (in FIGS. 5 and 6), one electrical contact may be placed in the side wall 182 and into the second chamber 186 and another contact in the pedestal 126. As pointed out, in connection with other embodiments of this invention, a plurality of contacts may be placed in the second chamber 184 and arranged to provide a coded signal output.

In addition, it is possible to dimension a plunger 188 (FIG. 10) to have more than one chamfer. Thus, there may be, as shown, two such chamfers 190 and 192 similar in configuration to the previously provided chamfer 152 of the plunger 146 of FIGS. 5 and 6. In this way, contacts may be located in each chamfer 190 and 192 to provide a double pole switch. It will be noted that the base 194 of the plunger 188 does not form an acute angle with respect to the radial plane.

Still another configuration for plungers and housings may be employed to take advantage of the mercury's natural tendency to avoid the juncture of two planes. For example, the plunger 196 (FIG. 8) and the inner housing 198 (FIG. 9) may take the shape of a rectangular prism. Mercury 200 placed in such a housing 198 will naturally avoid the corners leaving spaces. These spaces are an important characteristic of the switch if it is desired to avoid the problems created by trapped gases.

Mercury switches with large amounts of mercury can trap a gas between the mercury and the electrical contacts. Thus, if a large plug of mercury were to be placed in the switch of this invention, it is possible to have the gas enter the space between the mercury and the contact — particularly at the base. If there is no way of removing this gas, the switch becomes inoperative.

If, on the other hand, the entrapment of gases is not considered a problem (because of the restricted environment in which the switch is to be used, then the switch will operate with larger quantities of mercury.

Another important aspect of this invention is the disposition of the internal atmosphere of the switch. It is believed that switches previously proposed that are designed to take advantage of the restorative forces of mercury set forth the necessity of reducing the volume of the container holding the mercury, thereby creating a problem of compressing internal gases or the necessity of working within a vacuum. This problem is overcome in this invention. It will be observed that the relative dimensions of the plunger and inner housing will prevent the mercury from leaving the two predetermined chambers. As the size of these chambers varies, however, the gas within the switch will easily pass about the plunger. Thus, the effective volume of the trapped gas remains substantially constant while the effective volume of the mercury-contained chambers varies. Thus, the plunger is not required to work in a vacuum or to work against compressed gases.

Another advantage to the present switch is the flexibility of providing electrical contacts through any desired portion of the switch housing. Thus, in connection with the switch 120, both contacts 134 and 136 extend through the planar base 124. The facility of this design, and in particular the ability to use plastics, makes possible the use of the planar bottom surface 124. Thus, the plugging in and out of a circuit board becomes feasible. Many other mercury switches employ glass as the housing member. In such a case, the electrical contacts are sealed shut by glass pinch seals. Such a design limits the ability to plug a device into a circuit board, for example. This is because such seals are brittle.

Figure 4:
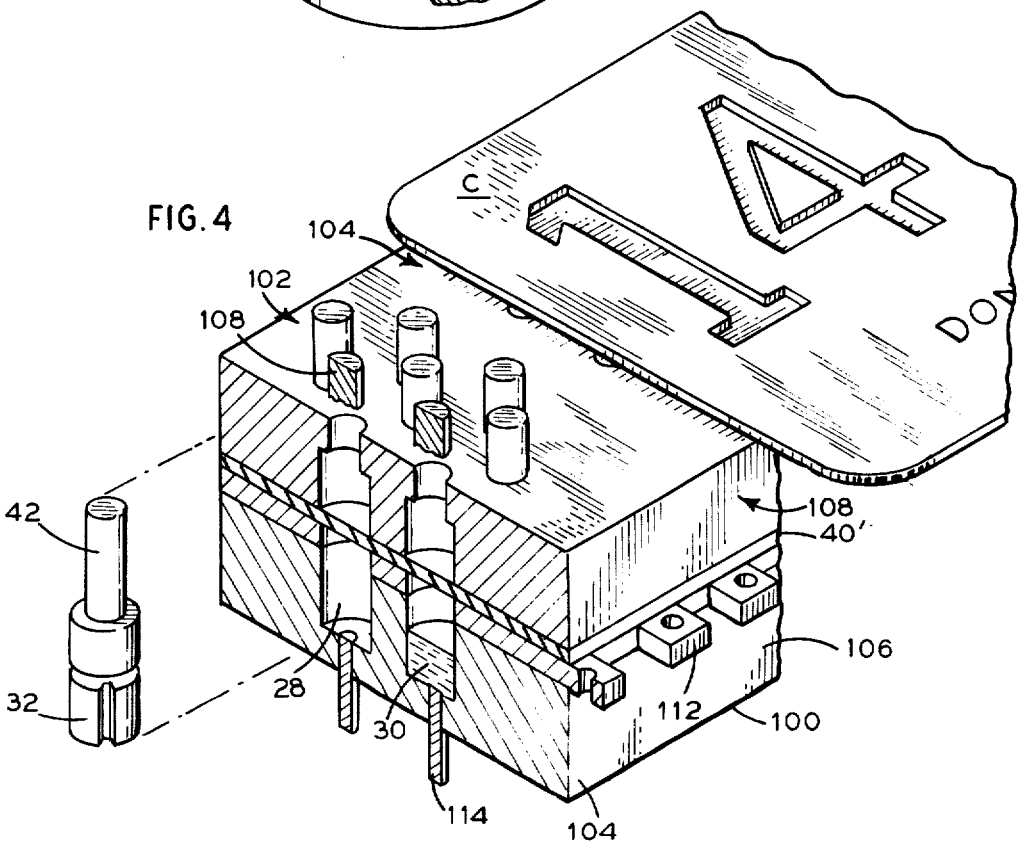
FIG. 4 is a perspective and partially sectioned view of a further embodiment of the switch of this invention.

The advantage of the switch of this invention may be immediately seen with respect to the switch block design of FIG. 4. Instead of strip conductors 112, separate contacts may be provided and the entire module or switch block may be plugged into any desired system.

Throughout this discussion, the various embodiments employ the Ganot effect. Thus, interesting surfaces are used to encourage the movement of mercury 130 from the second chamber 186 back to the first chamber 184. In this way, the angle formed by the surface of the chamfer 152 and the side wall 182 makes possible the return of the mercury 130 from the second chamber 186 to the first chamber 184 irrespective of the orientation of the switch 120 with respect to the pull of gravity. In addition, the thinner the column of mercury 130 in the second chamber 186 (and, consequently the lower its mass), the less force is required to remove it therefrom by the Ganot effect and the restorative force of the mercury 130 in the first chamber 184.

While wetted contacts are not a requirement in the successful operation of the switch 120, the use of such contacts provides other valuable operating characteristics. Thus, for example, if the base and chamfer contacts 134 and 136 are wetted, mercury makes immediate contact therewith. As the mercury 130 is withdrawn from the chamfer contact 136, a small quantity of mercury 149 remains adhered to the contact 136. This remaining mercury 149 makes for a complete contact when the mercury column is displaced by the plunger 146 into the second chamber 186. As a result, the switch operation is bounceless.

The use of wetted contacts also provides the switch 120 with an inherent hysteresis effect. Hysteresis, as used herein, means that the switch will make or turn ON at a different point in space than it "breaks" or turns OFF. Thus, it has been observed that the switch will make contact with the groove contact 136 at a distance which is further from the fully OFF position of the push button 172 than the break distance. There is thus provided, for a given downward-upward stroke time of the plunger 146, a longer ON time than OFF time. This extended ON time frame assures a reliable indication that a true signal has been provided by the switch.

Of further note is the venting characteristics of the switch. As previously indicated, the mercury on a non-wettable surface tends at every opportunity to draw into a sphere. Thus, at corners, the mercury 130 resists making contact at the intersecting surfaces. This characteristic, as has been previously discussed, is used to vent the gas within the cavity about the mercury as the mercury moves from one chamber to the other. In this way, gas does not become entrapped between mercury 130 and the contacts 134 and 136. This may be clearly seen in FIG. 11 where mercury 130 displaced from the first chamber 184 into the second chamber 186 leaves spaces 202 between the chamfer 152 and the wall 182.

In still another embodiment of this invention, there is disclosed a switch 20. The switch 20 has a first housing member 22 which, as shown in FIG. 1, has a bottom wall 24 (shown in edge view in FIG. 1) and a cylindrically-shaped side wall 26 forming there within a generally cup-shaped cavity 28. While the cavity 28 is shown herein to be cup-shaped (i.e., a cylindrical side wall and a planar bottom wall) it will be appreciated that any shaped cavity may be used. The first housing 22 of this invention is preferrably made of an insulating material such as plastic or the like. If the housing 22 is to be used as an electrical contact, which will be more fully explained below, then the first housing 22, or a part thereof, may be made of an electrically conductive material.

Within the cavity 28 is an electrically conductive liquid 30 which is preferrably mercury. In contact with the mercury 30 is a plunger 32. The plunger 32 has, in the preferred embodiment, a cylindrical shape. The outer surface of the plunger 32 is proximate the interior surface of the side wall 26. The plunger 32 has a slot 34 therein which is preferrably substantially perpendicular to the bottom wall 24. However, perpendicularity of the slot 34 is not entirely necessary for operation of the switch 20. The cross-sectional area of the slot 34 is, with respect to the cross-sectional area of the plunger 32, small. The relationship of the dimensions of the slot 34 to the plunger 32 dimensions is more fully discussed below. Suffice it to say, the plunger 32 may be any shape (i.e., elipsoid, square, etc.) so long as it generally conforms to and is substantially proximate the inner surface of the housing wall 26.

A plurality of electrical contacts, and more particularly two such contacts 36 and 38 are shown (FIG. 1) disposed extending through suitable apertures in the side wall 26 and into the slot 34. The contacts 36 and 38 may be made of any electrically conductive material such as platinum, molybdenum, or the like. The contacts 36 and 38 are so arranged that they come into contact with the mercury 30 in a manner to be more fully described below.

The top of the cavity 28 may be sealed shut by a resilient cover 40 or membrane which may be made of, for example, rubber, Teflon, or the like. The cover 40 encloses within the cavity 28 the plunger 32 and the mercury 30. The membrane 40 is in close contact with the top of the plunger 32 and may be secured to the top of the housing 22 by securing means such as glue or the like.

Resting upon the membrane 40 is a push button contact 42 which may be in the form of a finger, ball, or the like. The function of this push button contact or stem 42 and its relationship to the rest of the switch 20 will be more fully described below. The stem 42 (FIG. 1) is generally doorknob shaped with the wider portion 44 resting upon the membrane 40. The outer circumference of the wider portion 44 is preferrably no larger than the inner diameter of the cavity 28 defined by the inner surface of the side wall 26 of the housing 22. This is found to be preferrable since it is the contact 42 which will move the plunger 32 downwardly. However, so long as downward motion is imparted to the plunger 32, the particular dimensions and shape of the contact 42 is not considered essential to the operation of the switch 20.

The contact 42 has an upwardly extending stem 46. A second housing or cover 48 has a cylindrically-shaped side wall 50 which as disclosed in FIG. 1 conforms generally to the side wall 26 of the housing 22. The cover 48 is generally cup-shaped and is joined to the housing 22 by any well-known means of securing, such as by glue, threaded joining, or the like, at the open ends thereof. The bottom wall 52 of the cover 48 is placed opposed to the bottom wall 24 of the first housing 22. The stem 46 of the contact 42 passes from within the housing 48 and without through a suitably disposed aperture 54. In place of the contact 42, as has been previously mentioned, there may be a ball or similar means.

In operation, the contact 42 is depressed. The resilient cover 40 moves under the pressure of the contact 42 and the plunger 32 moves downwardly. The mercury 30 is, as a result of the plunger's downward movement, forced up within the slot 34. As shown in FIG. 1, the slot 34 is generally rectangular in shape and is principally defined by the plunger 32 and side wall 26. It is to be understood that the slot 34 may be defined by providing the plunger 32 with a substantially planar side or a slot in the side wall 26 of the housing 22 (see for example FIG. 2).

One desirable aspect of this switch 20 is the sensitivity thereof. That is, slight movements of the contact 42 can cause the switch 20 to operate. Thus, with a slight depression of the contact 42, the mercury 30 flows up the slot 42 closing or electrically coupling the contacts 36 and 38.

The type of material used for a plunger and housing is of importance since it is desirable that the mercury not adhere to the walls thereof. Nonreactive plastics, such as Teflon, Delrin, or Selanex have been found to be useful in this regard.

Of particular note and importance to the operational characteristics of the switch of this invention is the following. For example, if the cavity has an overall length of 0.2 of an inch, the plunger can have a length of 0.18 of an inch, the cavity can have as a diameter 0.05 of an inch and the plunger may have a running fit of about 0.049 of an inch.

It has been observed that a downward pressure upon a plunger which does not have a slot therein, will cause mercury to move up along the side walls in a rather erratic and somewhat unpredictable manner. However, it the slot 34 in the plunger 32 has a depth of, for example, 0.015 inches and a width of 0.02 inches, downward pressure upon the plunger 32 will cause the mercury 30 to rise substantially within the slot 34. This phenomenon is the result of the surface tension of the mercury 30 and the relative dimensions of the plunger 32, cavity 28, and slot 34. Thus, in the example given, if the plunger 32 is moved downward, for example, a distance of 0.02 inches, the column of mercury will move up the passageway 0.12 inches. This obvious multiplication factor is a function of the relative cross-sectional areas of the plunger 32 to the slot 34.

It has been observed that upon release of the plunger 32, the mercury 30 returns to the bottom wall 24 of the housing 22, pulled there, in the embodiments of FIGS. 1 - 4, by at least the forces set up by the mercury's surface tension. Upon the return of the plunger 32 to its initial or starting position, the mercury 30 leaves the slot 34. The plunger 32 may be adhered or affixed to the membrane 40. The membrane 40 will assist the plunger 32 to return to its original position.

It is well known that most mercury switches are sensitive to orientation with respect to the pull of gravity. That is, if the switch is moved, the flow of mercury may inadvertantly open or close the switch. As has been previously observed, the present device is insensitive to the effects of gravity. Thus, for example, in the switch 20 dimensioned as above, it has been observed that the slot 34 can be placed substantially perpendicular to the pull of gravity, or on its side, before the switch 20 becomes inoperative. The embodiments of FIGS. 5 - 10 may be operated at any desired position, independent of the any disabling effect of gravity.

Another embodiment of the switch 20' (FIG. 2) discloses a housing 22' having therein a substantially cylindrically-shaped cavity 56. It should be noted that in this embodiment, as in others disclosed herein, similar reference numbers are used to indicate related or similar structures.

A narrow passageway 58 is within the side wall 60 of the housing 22'. This passageway 58 is similar to the slot 34 disclosed in the embodiment of FIG. 1. The top of the cylindrical side wall 60 of the housing 22' has a flange or lip 62. Within the cavity 56 is a quantity of an electrically conductive liquid 30' which, as before, may be mercury.

A resilient member 64 made of, for example, rubber or a similar material, may be secured to the lip 62 by glue or the like. The member 64 extends inwardly into the cavity 56.

A plunger 66 is, as has been previously described in connection with the first embodiment, generally conforms to the dimensions of the cavity 56. As disclosed, a smaller, generally cylindrically-shaped push button member 68 extends from the top of the plunger 66 as an integral part thereof. The plunger 66 resides within the cavity 56 and held by the resilient member 64. Thus, the resilient member 64 forms a boot supporting structure.

A second housing or cover 70 is generally cup-shaped and has a matching flange 72 at its open end for engaging the lip 62 of the housing 22'. The push button 68 extends through a suitably disposed opening in the top wall 74 of the cover 70.

It is not considered essential that the membrane or boot 64 and plunger 66 combination be required if the passageway 58 is in the side wall 60 of the housing 22'. Indeed, the slot or passageway 58 of this construction can be equally employed in the device of FIG. 1. As with the first embodiment, when the plunger 66 is depressed by a force exerted upon the push button 68, the mercury 30' rises in the passageway 58 to a height substantially determined by the relative cross-sectional areas of the plunger 66 and the passageway 58. The boot 64 serves to assist the plunger 66 to return to its original or initial position.

Figure 2:
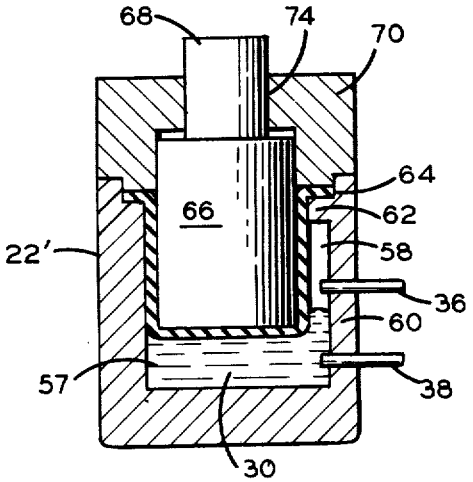
FIG. 2 is a partially sectional, elevational view of another embodiment of the switch of the invention.

Electrical contacts 36 and 38 extend through the wall 60 of the housing 22'. As shown in FIG. 2, the mercury 30' is in constant electrical contact with the lower contact 38 and couples the other contact 36 upon rising in the passageway 58.

Figure 3:
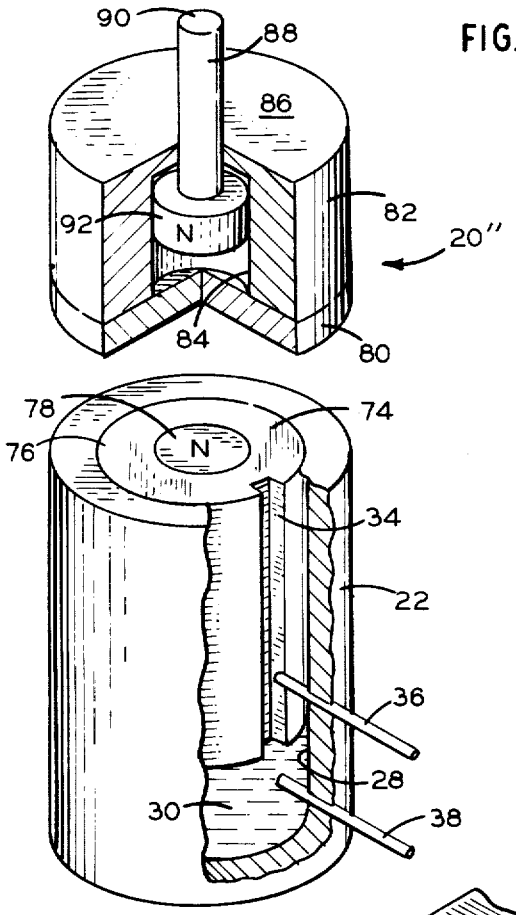
FIG. 3 is a partially sectioned perspective view of still another embodiment of the switch constructed in accordance with this invention.

Still another embodiment of a switch 20" constructed in accordance with the teachings of this invention, is disclosed in FIG. 3. A housing 22" may be, for example, cylindrically-shaped and have a generally cylindrically shaped cavity 28 there within. Electrical contacts 36 and 38 extend through the side wall of the housing 22 into the cavity 28. Mercury 30 is placed in the bottom of the cavity 28. A plunger 76 may be generally cylindrical in shape and have therein and rising substantially in parallel with the principal axis of the plunger 76. The plunger 76, which may be made of, for example, Delrin or any other nonreactive plastic, has coaxially disposed at the top end 78 thereof magnetic means which may be, for example, an ordinary magnet 80. In the example disclosed, the magnet 80 has one pole (N in FIG. 3) exposed.

A rigid member 81 is secured to a generally cylindrically shaped second housing or cover 82. The rigid member 81 may be made of a relatively thin material capable of passing there through a magnetic field. The member 81 may be generally disk-shaped and is disposed as to enclose the top of the housing 22". The cover 82 may be generally cylindrical in shape and have therein a cylindrically-shaped cavity 84. The exposed end 86 of the cover 82 has therein a centrally disposed aperture of narrower dimension than the cavity 84 therewithin. A push button 88 has a rod-shaped member 90 extending through the aperture in the end of the cover 82. The rod 90 is, in turn, secured to a disk-shaped magnet means 92, which may be an ordinary magnet having a pole disposed proximate the plunger 76. The disk-shaped magnet 92 conforms substantially to the configuration of the cavity 84 of the cover 82 and may be movable vertically there within. It is to be understood that the shape of the cavity 84 of the cover 82 is substantially a matter of design choice and not confined to the particular shape disclosed.

The magnet 92 is so disposed that the same pole (north) faces the first magnet 80 in the plunger 76 so that the tendency of the equal poles to oppose and repel is employed. Thus, when the push button 88 is depressed, the plunger 76 moves downwardly into the mercury 30. Upon release of the push button 88, the mercury 30 flows back into the base. The plunger 76 moves upwardly and the push button 88 moves in response to the repelling force of the magnetic field.

Truning now to a principal application of the switch of this invention, there is disclosed a plurality of switches in a switch block 100. Specifically, the switches are arranged in groups of seven switches. One group 102 is shown. Each group of switches 102 represents a position. A complete switch block 100 has such a grouping for each indicia location to be read. Where the sensing contacts 42 are employed to sense or read the embossed indicia on credit cards C, for example, each grouping simultaneously gives a reading of the indicia embossed thereon. Thus, upon reading a credit card, these switches 102 will simultaneously provide signals indicative of the numbers. By an extension of the disclosed arrangement, the switches can be employed to read punched or embossed indicia on tags, labels, hollerith cards, and the like.

The design of the switch block 100 is convenient from the standpoint of manufacture. As may be easily appreciated, the base or first housing 106 may be made of a single block of insulating material, such as plastic of the types previously discussed. The cavities 28" for each switch 20 may be conveniently molded or drilled in a single operation. In the same manner a second housing or cover 108 with a complimentary configuration is provided. The individual cavities 104 thereof, like those of the housing 106 are, in the embodiment disclosed in FIG. 4, essentially the same as that of FIG. 1.

The plunger 32 and push button 42 may be the same as has been described in connection with FIG. 1. It should be appreciated, however, that any of the embodiments disclosed herein are adaptable to the switch block concept. The membrane 40' is, for simplicity of construction, a singular sheet of a resilient material such as Teflon, rubber, or the like.

Each group 102 of push buttons 42 may be arranged in columns 110, have their own series of electrical contacts 112 in the form of an electrically conductive strip. The strip 112 forms a part of the housing wall of the cavities 28". The second contact 114 for each switch 20 extends into the cavities 28" at the base thereof.

In operation, the closing of a switch — indication, for example, of the reading of indicia on a credit card C — is provided when current flows through the contacts 112 and 114 and the coupling mercury 30 in the slot 34.

From the foregoing it will be realized that the switch in its various embodiments or in the concept of a switch block may be advantageously used to read information from any indicia bearing media or, in an alternative, as a keyboard switch for calculators. If a plurality of contacts are arranged along the slot or slots of a plunger, and arranged such contacts one above the other (not shown), a binary output dependent upon the height of the mercury is provided.

Clearly, because the plunger, mercury, and contacts are separated from the mechanical actuation portions, the switch of this invention is less subject to failure caused by dirt or dust. The important and critical dimensions, such as contact separation, passageway or groove dimensions, and the like, are within the sealed portion of the switch. Thus, the exposed parts are less critical and are less likely to be made inoperative by dust or dirt.

What is claimed is:

1. An electrical switch comprising:
   a. housing means having a cavity therewithin, said cavity is defined by surfaces of said housing;
   b. electrically conductive liquid means within said cavity and supported upon a first of said housing surfaces;
   c. plunger means within said cavity; at least a part of said plunger means and a part of a second of said housing surfaces defining therebetween at least one passageway, said passageway extending substantially upwardly with respect to said first surface of said housing; and
   d. electrical contact means comprising electrical contacts for providing a conductive path from outside of said housing means into said cavity, at least one of said contacts is proximate said passageway;
   e. said plunger, upon being depressed from an initial position, displaces at least a part of said liquid;
   f. said plunger and said cavity are so dimensioned such that said displaced liquid is substantially restricted to said passageway.

2. A switch of the type operable in response to a magnetic field comprising:
   a. housing means having a cavity therein;
   b. plunger means within said cavity and having at least two operating positions, said plunger having at least one wall which, in combination with said cavity wall defines at least one chamber, said chamber having a peripheral portion means and an interior portion means;
   c. conductive liquid within said interior portion and, with said plunger in said first position, remaining substantially therewithin, independent of the pull of gravity; at least a portion of said conductive liquid being displaced into said peripheral portion with said plunger in said second position; and
   d. means for providing electrical contacts from within said cavity and without said switch housing; said liquid, with said plunger in one of said positions, electrically coupling at least two of said electrical contacts; said liquid, with said plunger in the other of said positions, electrically uncoupling said contacts.

3. A switch as recited in claim 2 further comprising means for recirculating relatively small amounts of said conductive liquid which passes out of said chamber.

4. A switch as recited in claim 3 further comprises a gas within said cavity and said recirculating means comprises means for venting said gas from within and without of said chamber and within said cavity.

5. A switch as recited in claim 4 wherein said interior portion comprises a first chamber and said peripheral portion comprises a second chamber.

6. A switch as recited in claim 5 wherein a substantial part of said cavity and said plunger are of an unwettable substance with respect to said liquid and said liquid having a surface skin which holds said liquid within said first chamber with said plunger in said first position independent of said pull of gravity.

7. A switch as recited in claim 2 wherein said housing cavity has therein a recess at least one of said contacts being in said recess and being wettable, a quantity of said electrically conductive liquid being within said recess and about said contact thereby forming a continuous wet contact.

8. A switch as recited in claim 6 wherein at least one of said chambers is defined by at least two walls forming therebetween, in cross section, an acute angle with the apex of said angle substantially coincident with a marginal edge of said chamber such that said conductive liquid disposed within said chamber and brought proximate said angle is subject to the Ganot effect.

9. A switch as recited in claim 8 wherein said second chamber having said acute angle, said angle being defined by said plunger and said cavity wall such that said conductive liquid placed therein is subject to said Ganot effect.

10. A switch as recited in claim 9 wherein said gas, plunger, and liquid being sealed within said cavity and are so disposed such that said liquid is confined to said chambers and said gas and plunger are confined to said cavity, said chambers varying in volume as said plunger is moved within said housing.

11. A switch as recited in claim 10 wherein said recirculating means further comprises a quantity of said conductive liquid being within said cavity and without said chambers, and means for communicating any of said conductive liquid being passed about said plunger from said chambers back to said chambers thereby recirculating said conductive liquid.

12. A switch as recited in claim 8 wherein said cavity is defined by at least base and side walls of said housing;

said plunger compliments at least a portion of said side walls;

said first chamber is defined by a bottom wall of said plunger, said bottom and side walls of said cavity, and the relative position of said plunger and said cavity walls.

13. A switch as recited in claim 12 wherein said second chamber is defined by a chamber in said plunger and side wall of said cavity.

14. A switch as recited in claim 12 wherein said chamber is angularly disposed toward said side wall of said cavity to form an acute angle therewith, said angle opening into said first chamber.

15. A switch as recited in claim 14 wherein said venting means comprises said plunger and said cavity wall forming therebetween a space substantially smaller in cross-section than said chambers and in communication therewith;

said communicating means comprises said plunger and said cavity wall defining therebetween a conduit within said cavity extending into said first chamber such that upon any of said conductive liquid being scattered from said chambers and joining said quantity of said conductive liquid in said cavity, a portion of said conductive liquid, substantially equal to said scattered conductive liquid, being displaced therefrom, by motion of said plunger from one of said operating positions to the other of said operating positions, and pumped through said conduit to said first chamber, thereby maintaining the quantity of said conductive liquid in said chambers substantially constant.

16. A switch as recited in claim 15 wherein said bottom wall of said plunger and said base wall of said cavity form at least a part of two planes which approximately intersect at the marginal edges thereof with said plunger in said second position.

17. A switch as recited in claim 15 wherein said housing cavity and said plunger are substantially cylindrical in shape, said liquid is mercury, said base wall of said cavity is generally concave and conical.

18. A switch as recited in claim 15 wherein said cavity and said plunger are generally rectangular prisms, said liquid is mercury.

19. A switch as recited in claim 17 further comprises moving means; said plunger comprises magnetic responsive means;

said moving means comprises magnetic means for moving said plunger within said cavity and a source of magnetic flux emanating exterior of said cavity for moving said magnetic responsive means.

20. A switch as recited in claim 18 further comprises moving means, said plunger comprises magnetic responsive means, said moving means comprises magnetic means for moving said plunger within said cavity and a source of magnetic flux emanating exterior of said cavity for moving said magnetic responsive means.

21. A switch as recited in claim 5 further comprises a plurality of said second chambers defined by said plunger and said housing cavity.

22. A switch as recited in claim 19 further comprises push button actuation means for moving said source of magnetic flux with respect to said magnetic responsive means, said push button actuation means comprises resilient means.

23. A switch as recited in claim 22 wherein said housing comprises:

a base member having a substantially planar exterior wall, a pedestal, and an arm; said arm being adjacent said pedestal and substantially perpendicular and opposed to said planar surface; said pedestal upper surface comprises said cavity base; and a hollow cylindrical housing secured to said base about said pedestal and closed at the opposing end thereof to form, with said base, said cavity, said arm combining with said hollow housing to form a substantially cylindrical cavity side wall; said arm extending only partially within said housing forming between the free end thereof and said housing wall a recess, said recess communicating into said cavity;

said mercury in said first chamber being upon said base;

one of said electrical contacts comprises a conductive wire sealed within said base and extending from the apex of said base through said planar surface;

another of said electrical contacts comprises a conductive wire sealed within said base member and extending from within said cavity, through said arm, and out said exterior wall;

said push button actuation means comprises a push button housing exterior of said hollow housing;

said resilient means comprising a spring about said hollow housing;

said source of flux comprises a toroid magnet about said hollow housing and upon said spring; said push button housing moving said magnet against said spring so as to move said plunger from said first to said second position;

said magnetic responsive means comprises magnetic responsive material within said plunger;

said hollow housing comprising means for coating with said plunger and orienting said plunger within said cavity;

said small quantity of mercury within said cavity and outside of said chambers being between said plunger and said housing opposed to said base, said conduit comprises a flat in said plunger; said conduit having a smaller cross-sectional dimension than said chambers.

24. A switch as recited in claim 20 further comprises push button actuation means for moving said source of magnetic flux with respect to said magnetic responsive means, said push button actuation means comprises resilient means.

25. A switch as recited in claim 12 wherein with said plunger in said first position, said surface skin of said liquid is so disposed within said cavity such that there is an absence of said gas entrapped between said liquid and any of said walls upon which said liquid rests, said lack of entrapment being independent of the orientation of said switch.

26. A switch as recited in claim 17 wherein with said plunger in said first position, said surface skin of said liquid is so disposed within said cavity such that there is an absence of said gas entrapped between said liquid and any of said walls upon which said liquid rests, said lack of entrapment being independent of the orientation of said switch.

27. A switch as recited in claim 18 wherein with said plunger in said first position, said surface skin of said liquid is so disposed within said cavity such that there is an absence of said gas entrapped between said liquid and any of said walls upon which said liquid rests, said lack of entrapment being independent of the orientation of said switch.

28. A switch comprising:

a. means for housing said switch having a cavity therewithin;

b. a quantity of an electrically conductive liquid within said cavity;

c. plunger means within said cavity and defining, in combination with the walls of said cavity, at last two chambers; said chambers being in communication with one another; said plunger having at least a first and second operating position; with said plunger in said first position, said liquid residing substantially in said first chamber; with said plunger being in said second position, at least a portion of said liquid being displaced into said second chamber; said liquid occupying said chambers being substantially independent of the pull of gravity;

d. means for providing electrical contacts from said cavity to without said switch; said liquid, in one of said plunger positions, electrically coupling said electrical contact means; said liquid, in another of said plunger positions, uncoupling said electrical contact means; and e. means for moving said plunger from one of said positions to another of said positions.

29. A switch comprising:

a. housing means having a cavity therewithin;

b. plunger means within said cavity, for relative movement between said plunger and said housing;

c. mercury within said cavity;

d. means for substantially retaining said mercury within predetermined portions of said cavity;

e. means for recirculating said mercury within said cavity and about said plunger such that said mercury within said predetermined area remains substantially constant; and f. electrical contact means within said housing and extending without said cavity and said housing and comprising at least two electrical contacts;

g. said plunger in one position, relative to said housing, displacing said mercury so as to electrically couple said contacts; and in a second position, said two contacts being uncoupled, thereby forming a switch.

30. An electrical switch comprising:

a. a housing having a cavity therewithin;

b. mercury within said housing cavity;

c. electrical contact means within said housing cavity, at least one of said contacts being wettable, said housing cavity having a recess formed within a wall thereof, said contact being within said recess such that a small amount of said mercury is held upon said wettable contact and retained within said recess so as to provide a liquid contact for said switch, and d. means for placing said mercury into electrical contact with wettable contact and at least one other contact within said cavity.

* * * * *